US006582270B2

(12) United States Patent
Frybarger

(10) Patent No.: US 6,582,270 B2
(45) Date of Patent: Jun. 24, 2003

(54) DISC AND A METHOD FOR FORMING THE SAME

(76) Inventor: Scott Frybarger, 929 E. High St., Mt. Vernon, OH (US) 43050

( * ) Notice: Subject to any disclaimer, the term of this patent is extended or adjusted under 35 U.S.C. 154(b) by 0 days.

(21) Appl. No.: 09/899,599

(22) Filed: Jul. 5, 2001

(65) Prior Publication Data

US 2003/0008594 A1 Jan. 9, 2003

(51) Int. Cl.[7] ..... A63H 27/00
(52) U.S. Cl. ..... 446/46
(58) Field of Search ..... 446/46, 47, 48

(56) References Cited

U.S. PATENT DOCUMENTS 4,207,702 A * 6/1980 Boatman et al. ..... 446/46
4,351,129 A * 9/1982 Kerkenbush et al. ..... 264/248
4,846,749 A * 7/1989 Petko ..... 446/36
4,940,441 A * 7/1990 Novinsky ..... 446/46
5,116,275 A * 5/1992 Sassak ..... 446/48
5,351,967 A * 10/1994 Yang ..... 446/46
5,620,351 A * 4/1997 Ho ..... 446/15
5,797,815 A * 8/1998 Goldman et al. ..... 446/46
5,951,353 A * 9/1999 Moore ..... 446/247
6,089,998 A * 7/2000 O'Neal et al. ..... 473/588

* cited by examiner

*Primary Examiner*—Jacob K. Ackun
*Assistant Examiner*—Faye Francis
(74) *Attorney, Agent, or Firm*—Patents+TMS, P.C.

(57) ABSTRACT

A toy and a method for forming the same are provided. The toy and the method include a disc having an upper convex surface, a lower convex surface, a centerpiece and a band. The centerpiece may be constructed of a heavier composition than the upper convex surface and the lower convex surface and may be disposed between them such that natural gyration and depth control are achieved upon throwing the disc. The band attaches around a perimeter of the upper convex surface and the lower convex surface and may be constructed from a buoyant material. The band may have a rigid surface for easier gripping. A user may throw the disc on a flight pattern, which may include, for example, skipping the disc off a surface such as, for example, water.

18 Claims, 1 Drawing Sheet

DISC AND A METHOD FOR FORMING THE SAME

BACKGROUND OF THE INVENTION

The present invention generally relates to a toy or an amusement device and a method for forming the same. More specifically, the present invention relates to an apparatus to throw between users and/or for use in water wherein the apparatus may skip across a surface of the water.

It is, of course, generally known to provide saucer-shaped toys, generally known, for example, as Frisbees, to throw back and forth between users. Normally, users stand at a distance between themselves and throw the toy back and forth to each other. The toys tend to drift through the air following a flight pattern with minimal resistance due to the aerodynamic shape of the toy and a lack of frictional disturbances to divert the flight pattern of the toy.

Such known toys typically have a disc with a convex upper surface and a concave lower surface. The surfaces allow air to flow under the toy which keeps the toy afloat. Typically, if such a toy comes into contact with another object, such as the ground or a body of water, the toy diverts from the flight pattern. These toys do not have the ability to continue an intended flight pattern when a frictional force interrupts the flight pattern of the toy. Known toys of this design are not made to "skip" off a water surface. Known toys are immediately diverted from their intended target because the water interrupts or stops the intended flight pattern of the toy.

A need, therefore, exists for an improved toy and method for forming the same that maintains a specific flight pattern when thrown against a water surface by a user.

SUMMARY OF THE INVENTION

The present invention generally relates to an apparatus and a method for forming the same having an upper convex surface and a lower convex surface, a centerpiece and a buoyant band which, when thrown or "skipped" across a water surface, may travel in a specific intended flight pattern.

In an embodiment of the present invention, an apparatus is provided. The apparatus has a disc having a central axis and a perimeter wherein the disc is formed from an upper convex surface and a lower convex surface wherein the upper convex surface attaches to the lower convex surface. A centerpiece is arranged along the central axis of the disc wherein the centerpiece extends between the upper convex surface and the lower convex surface.

In an embodiment, the centerpiece has a venturi shape.

In an embodiment, the centerpiece is constructed from a material that is heavier than the lower convex surface.

In an embodiment, the upper convex surface, the lower convex surface and the centerpiece are integrally formed.

In an embodiment, the disc is constructed from a material having a buoyant composition.

In an embodiment, the disc is a fluorescent color.

In an embodiment, a band is attached to the disc.

In another embodiment of the invention, a disc is provided having a central axis and a perimeter wherein the disc is formed from an upper convex surface and a lower convex surface wherein the upper convex surface attaches to the lower convex surface. A band is attached to the perimeter of the disc.

In an embodiment, a plurality of spaced openings is provided in the band.

In a further embodiment, a plurality of ridges is provided in the band.

In an embodiment, the disc is a fluorescent color.

In an embodiment, the disc is constructed from a material having a buoyant composition.

In another embodiment, the band is constructed from a material having a buoyant composition.

In an embodiment of the present invention, a method is provided for forming a disc comprising the step of: providing an upper convex surface and a lower convex surface of the disc wherein the upper convex surface is attached to the lower convex surface along a central axis; and providing a centerpiece wherein the centerpiece is secured between the upper convex surface and the lower convex surface along the central axis.

In an embodiment, a method is provided for constructing the centerpiece from a material that is heavier than the upper convex surface and the lower convex surface.

In an embodiment, a method is provided for forming the centerpiece in a venturi shape.

In another embodiment of the present invention, a method is provided for assembling a disc. The method comprises the steps of: providing an upper convex surface and a lower convex surface wherein the upper convex surface is attached to the lower convex surface along a central axis; and providing a band secured between the upper convex surface and the lower convex surface wherein the band is attached equidistantly from the central axis.

In an embodiment, a method is provided for forming a plurality of ridges in the band.

In an embodiment, a method is provided for providing a plurality of spaced openings in the band.

In an embodiment, a method is provided for weighting the upper convex surface and the lower convex surface uniformly around the central axis.

It is, therefore, an advantage of the present invention to provide an apparatus and a method wherein a user may skip a disc across a water surface.

Another advantage of the present invention is to provide an apparatus and a method wherein a disc may continue a specific, intended flight pattern without diversion that may normally be created by contact with a water surface.

Another advantage of the present invention is to provide an apparatus and a method wherein a disc has a ridged edge that allows a user to maintain a grip on the disc.

Another advantage of the present invention is to provide an apparatus and a method wherein a disc has a ridged edge that is buoyant.

Still another advantage of the present invention is to provide an apparatus and a method wherein a disc may be used by one or more users.

Yet another advantage of the present invention is to provide an apparatus and a method wherein a disc is simple to manufacture.

Another advantage of the present invention is to provide an apparatus and a method wherein a disc may be used in a pool.

Yet another advantage of the present invention is to provide an apparatus and a method wherein a disc may be skipped off different surfaces including, but not limited to, concrete, asphalt, grass, turf, artificial turf, wood, rock, dirt, water or clay.

Still another advantage of the present invention is to provide an apparatus and a method wherein a disc may be thrown into a specific flight pattern that does not include skipping the disc off a surface after a user releases the disc.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention generally relates to a toy and a method for using the same. More specifically, the present invention relates to an apparatus for throwing back and forth between users and/or for use in water wherein the apparatus may "skip" across a surface of the water.

Figure 1:
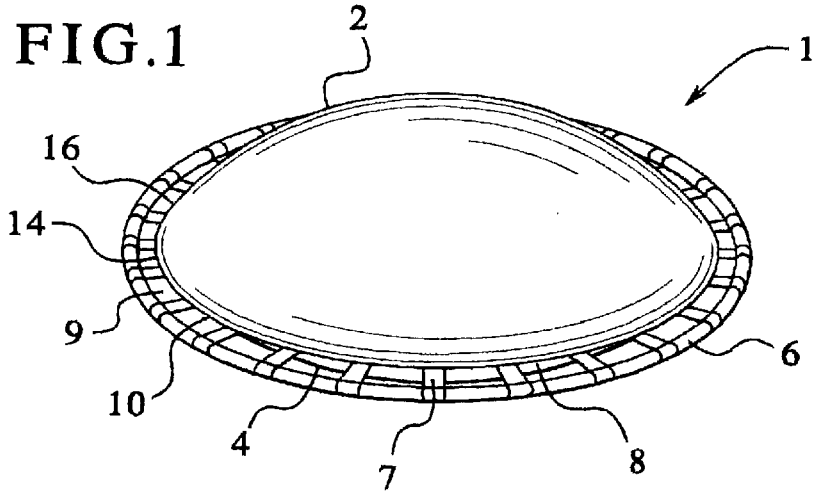
FIG. 1 illustrates an elevated view of an embodiment of a disc of the present invention.

Referring now to the drawings wherein like numerals refer to like parts, FIG. 1 generally illustrates a toy 1 having an upper disc 2, a lower disc 4, and a band 6. Preferably, the upper disc 2 and the lower disc 4 may have a convex shape. The upper disc 2 and the lower disc 4 may be any color or different colors from one another. In a preferred embodiment, one or both of the upper disc 2 and the lower disc 4 may be flourescent color. The flourescent color provides additional visibility for the toy 1.

The upper disc 2 and lower disc 4 may have the same diameter or have different diameters relative to each other. In a preferred embodiment, the upper disc 2 and the lower disc 4 are equal in diameter. The upper disc 2 and the lower disc 4 both may have a round, disc-like shape or have different shapes relative to each other and relative to the round shape of a disc.

The band 6 may attach to the toy 1 along an outer perimeter 8 of the toy 1. Preferably, the band 6 may attach to an upper edge 10 and a lower edge 12 of the toy 1 along the outer perimeter 8. The band 6 may have a first surface 14 and a second surface 16. The first surface 14 and the second surface 16 of the band 6 may have ridges 7 and/or holes 9 to grip the band 6. The first surface 14 of the band 6 may attach to the upper edge 10, and the second surface 16 may attach to the lower edge 12 along the outer perimeter 8 of the toy 1. Alternatively, the toy 1 and the band 6 may be integrally formed. Preferably, the toy 1 and the band 6 are constructed from a material such that the toy 1 is buoyant.

Figure 2:
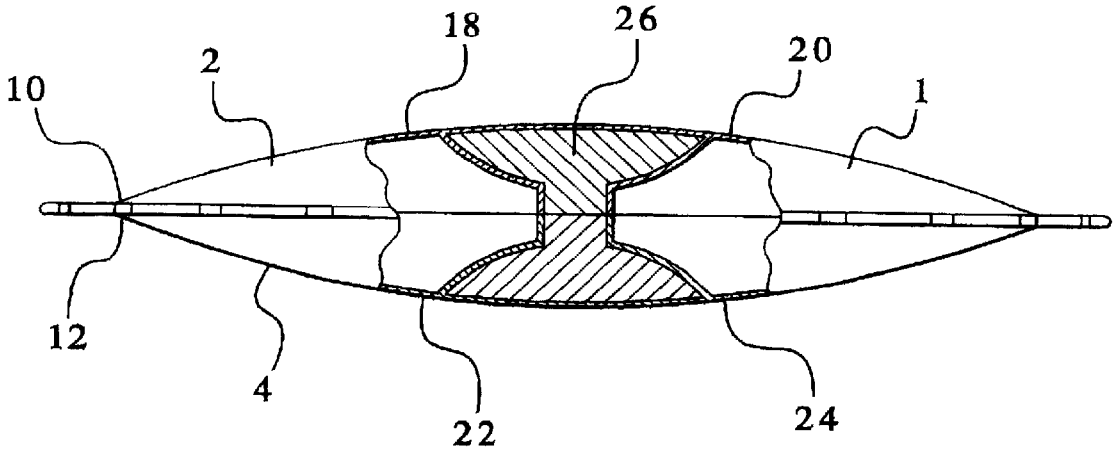
FIG. 2 illustrates a cross-sectional view of an embodiment of a disc of the present invention.
Figure 3:
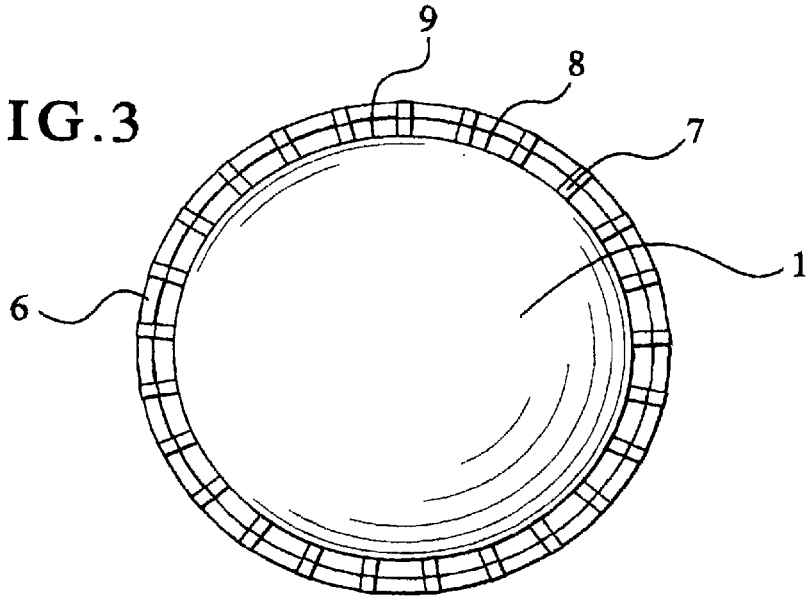
FIG. 3 illustrates a perspective view of an embodiment of a disc of the present invention.

FIG. 2 generally illustrates a cross-sectional view of the toy 1, and FIG. 3 illustrates a perspective view of the toy 1. The upper disc 2 of the toy 1 may have an upper convex surface 18 and a lower concave surface 20. The lower disc 4 of the toy 1 has an upper concave surface 22 and a lower convex surface 24. The upper convex surface 18 of the toy 1, when in use, may touch or skip across a surface, such as, for example, water. Alternatively, the lower convex surface 24 of the toy 1, when in use, may touch or skip across a surface, such as, for example, water. The lower concave surface 20 and the upper concave surface 22 may be the inner surfaces of the toy 1 and, if present, would be hidden from view when the toy 1 is fully assembled. Alternatively, the toy 1 may not be hollow as shown in the drawings, but may be constructed as a solid disc from a lightweight material, such as, for example, Styrofoam or foam rubber.

FIG. 2 further illustrates a centerpiece 26. The centerpiece 26 may be attached to the lower concave surface 20 and/or the upper concave surface 22 of the toy 1. Alternatively, the centerpiece 26 may be integrally formed with the toy 1. Preferably, the centerpiece 26 may have a venturi shape for added natural gyration of the toy 1 when used. Also, the centerpiece 26 is preferably constructed from a material that is heavier than the remainder of the toy 1 for added natural gyration of the toy 1 when used.

To use the toy 1, the toy 1 may be released into, for example, the air by a user throwing the toy 1. Alternatively, a user may release the toy 1 such that the toy 1 skips off various surfaces, such as, for example, water. To this end, the toy 1 may skip against a surface of the water such that one of the upper disc 4 or the lower disc 2 skips off the water thereby continuing on a specific flight pattern. Alternatively, the user may direct the toy 1 toward another user wherein the user stands a distance from the other user and directs the toy 1 to the other user. Alternatively, the user may stand a distance from the other user in a pool of water such that the user may skip the toy 1 off the water surface and into the hands of another user. The upper disc 2 may make contact with the water surface, or alternatively, the lower disc 4 may make contact with the water surface.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. An apparatus comprising:

a disc having a central axis and a perimeter wherein the disc has an interior defined between an upper convex surface and a lower convex surface wherein the upper convex surface attaches to the lower convex surface; and a centerpiece arranged along the central axis of the disc wherein the centerpiece is within the interior of the disc and is continuously formed between the upper convex surface and the lower convex surface wherein the centerpiece has an upper segment adjacent the upper convex surface, a lower segment adjacent the lower convex surface, and a middle segment wherein the upper segment and the lower segment have a larger diameter than the middle segment.

2. The apparatus of claim 1 wherein the centerpiece is constructed from a material that is heavier than the disc.

3. The apparatus of claim 1 wherein the upper convex surface, the lower convex surface and the centerpiece are integrally formed.

4. The apparatus of claim 1 wherein the disc is buoyant.

5. The apparatus of claim 1 wherein the disc is a fluorescent color.

6. The apparatus of claim 1 further comprising:

a band attached to the disc.

7. An apparatus comprising:

a disc having a central axis and an outer perimeter wherein the outer perimeter is equidistant from the central axis and further wherein the disc is formed from an upper convex surface and a lower convex surface wherein the upper convex surface attaches to the lower convex surface; and a band attached to the outer perimeter of the disc wherein the band is continuously formed around the outer perimeter of the disc and further wherein the band is formed equidistant from the central axis wherein the band has a diameter greater than a diameter of the outer perimeter forming an opening between the outer perimeter and the band.

8. The apparatus of claim 7 further comprising:

a plurality of spaced openings in the band.

9. The apparatus of claim 7 further comprising:

a plurality of ridges in the band.

10. The apparatus of claim 8 wherein the disc is a fluorescent color.

11. The apparatus of claim 7 wherein the band is constructed from a material having a buoyant composition.

12. The apparatus of claim 7 wherein the disc is constructed from a material having a buoyant composition.

13. A method for forming a disc, the method comprising the steps of:

providing an upper convex surface and a lower convex surface wherein the upper convex surface is attached to the lower convex surface along a central axis; and providing a centerpiece having a top, a bottom and a middle wherein the top of the centerpiece is secured to the upper convex surface and the bottom of the centerpiece is secured to the lower convex surface along the central axis and further wherein the middle of the centerpiece has a diameter smaller than the top and bottom of the centerpiece and further wherein the top of the centerpiece tapers in diameter toward the middle of the centerpiece and the bottom of the centerpiece tapers in diameter toward the middle of the centerpiece.

14. The method of claim 13 further comprising the step of:

constructing the centerpiece from a material that is heavier than the upper convex surface and the lower convex surface.

15. A method for assembling a disc, the method comprising the steps of:

providing an upper convex surface and a lower convex surface wherein the upper convex surface is attached to the lower convex surface along a first perimeter equidistantly around a central axis forming the disc; and providing a band secured between the upper convex surface and the lower convex surface wherein the band is attached equidistantly from the central axis forming a second perimeter wherein the second perimeter is greater than the first perimeter to define an opening between the band and the disc.

16. The method of claim 15 further comprising the step of:

forming a plurality of ridges in the band.

17. The method of claim 15 further comprising the step of:

providing a plurality of spaced openings in the band.

18. The method of claim 15 further comprising the step of:

weighting the upper convex surface and the lower convex surface uniformly around the central axis.

* * * * *